US006875012B2

(12) United States Patent
Lyons et al.

(10) Patent No.: US 6,875,012 B2
(45) Date of Patent: Apr. 5, 2005

(54) MONOLITHIC PANEL FOR A GAS BURNER

(75) Inventors: David Charles Lyons, Red Wing, MN (US); Ted Victor Schroeder, Welch, MN (US); Gary Lee Butler, Silver Lake, MN (US); Steven G. Smith, Lakeville, MN (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 09/781,149

(22) Filed: Feb. 8, 2001

(65) Prior Publication Data

US 2002/0146655 A1 Oct. 10, 2002

(51) Int. Cl.[7] ..... F24C 3/00
(52) U.S. Cl. ..... 431/125; 126/512
(58) Field of Search ..... 126/512, 500, 126/92 R, 92 AC, 92 A, 520; 431/125, 126, 328

(56) References Cited

U.S. PATENT DOCUMENTS

| | | | | |
|---|---|---|---|---|
| 663,811 A | * | 12/1900 | Dudgeon | 431/125 |
| 2,348,614 A | | 5/1944 | Dinkfeld et al. | |
| 2,737,944 A | | 3/1956 | Person | |
| 2,875,747 A | | 3/1959 | Fish | |
| 3,301,249 A | | 1/1967 | Hendricks | |
| 3,304,931 A | | 2/1967 | Rose | |
| 3,758,317 A | * | 9/1973 | Moore | 501/95.1 |

(Continued)

FOREIGN PATENT DOCUMENTS

| | | | | |
|---|---|---|---|---|
| EP | 0 267 671 A1 | | 5/1988 | |
| FR | 2629178 | * | 3/1988 | 431/125 |
| GB | 429115 | * | 5/1935 | 126/92 AC |
| GB | 1033987 | | 6/1966 | |
| GB | 2179438 | * | 3/1987 | 126/512 |
| JP | 07080815 | | 3/1995 | |
| JP | 3171287 B2 | | 5/2001 | |
| WO | WO 01/61251 A1 | | 8/2001 | |

OTHER PUBLICATIONS

Dec. 2000, Photographic (copies) material referencing Travis Industries Model No. DV XL Fireplace (7 photos).

Berkshire™ Cast Iron & Stone Gas Stoves Brochure from Lopi Stoves showing Ember–Fyre™ Burner (2 pages).

Chemical Abstract No. XP000184374: "Heat–resistant electric insulating materials," *Chemical Abstracts*, vol. 100, No. 6, 1 pg. (Feb. 6, 1984).

Exhibit A, Drawing of burner assembly; 1 page.

Exhibit B, Skamol Insulation High Temperature Insulation Manual; Skamolex V–1100—Vermiculite Block Insulation; 2 pages.

http://www.woodstoves.co.uk/skamol.htm; Skamolex Insulating Bricks/Panels; Dec. 22, 2003; 4 pages.

*Primary Examiner*—Josiah C. Cocks
(74) *Attorney, Agent, or Firm*—Merchant & Gould P.C.

(57) ABSTRACT

A gas burner includes a monolithic burner panel coupled to a bottom burner member for use as a bottom panel of a combustion chamber enclosure. The burner panel includes at least one aperture for providing a gas/air mixture to a top surface of the burner panel for combustion. The burner panel includes at least one elevated area. The burner panel is a composite material formed from a compression molding process. The burner panel includes elevations that can be shaped into log structures to provide a realistic fire within a fireplace unit, stove, or insert.

8 Claims, 12 Drawing Sheets

U.S. PATENT DOCUMENTS 4,466,420 A 8/1984 Ernisse et al.
4,737,326 A 4/1988 Wirth et al.
4,869,664 A * 9/1989 Wright et al. ..... 431/125
4,875,464 A * 10/1989 Shimek et al. ..... 126/92 R
4,950,362 A 8/1990 Steinau et al.
5,092,313 A 3/1992 Blackburn et al.
5,388,566 A 2/1995 Smith et al.
5,647,340 A 7/1997 Shimek et al.
5,688,568 A 11/1997 Wolf et al.
5,915,374 A 6/1999 Susany
5,931,154 A * 8/1999 Hussong et al. ..... 126/512
5,941,237 A 8/1999 Shimek et al.
5,996,575 A 12/1999 Shimek et al.
6,004,493 A * 12/1999 Hussong ..... 264/87
6,006,743 A 12/1999 Shimek et al.
6,048,195 A 4/2000 Shimek et al.
6,077,467 A * 6/2000 Sinsley ..... 264/87
6,180,257 B1 1/2001 Brandt et al.
6,354,831 B1 3/2002 Wilk, Jr. et al.
6,361,725 B1 * 3/2002 Sinsley ..... 264/87
6,443,726 B2 * 9/2002 Atemboski et al. ..... 431/125
6,602,068 B2 8/2003 Atemboski et al.

* cited by examiner

MONOLITHIC PANEL FOR A GAS BURNER

FIELD OF THE INVENTION

The present invention relates to gas burners for fireplaces. More particularly, the gas burners include a monolithic burner panel that is used as a bottom panel of a combustion chamber enclosure.

BACKGROUND OF THE INVENTION

In the fireplace industry, gas burners are used for producing flames within a fireplace unit. A gas burner combusts gas/air mixtures to produce flames that attempt to mimic the appearance of a wood burning or natural fire. The gas/air mixture can be combusted within a combustion chamber enclosure with, for example, a tube burner or a pan burner. These systems require separate log elements not incorporated into the burner that are placed around or above the burner.

Some gas fireplace systems incorporate burners in hollowed out logs having apertures for distributing gas to the combustion chamber for combustion. Other systems include multi-piece constructions that require significant assembly upon installation. Fireplaces using these gas burner systems include viewable metallic structural elements and burner hardware that decrease the aesthetic value of the gas fireplace and overall viewing pleasure.

SUMMARY OF THE INVENTION

Generally, the present invention relates to a gas burner for use in a fireplace. The gas burner construction provides a monolithic unit for use in prefabricated gas fireplace units, stoves, or inserts.

In one respect, the invention relates to a gas burner for a fireplace. The gas burner includes a burner panel defining a top surface and a bottom surface, a bottom burner member coupled to the burner panel. The burner panel defines at least one aperture to provide a gas/air mixture to the top surface of the burner panel, and the burner panel comprises a compression molded material.

In another respect, the invention relates to a gas burner for a fireplace including a burner panel defining a top surface and a bottom surface and a bottom burner member coupled to the burner panel. The burner panel defines at least one aperture to provide a gas/air mixture to the top surface of the burner panel, and the bottom surface of the burner panel defines at least one cavity. The at least one cavity extends above at least a portion of the top surface of the burner panel.

In another respect, the invention relates to a gas burner for a fireplace including a burner panel defining a top surface and a bottom surface, and a bottom burner member coupled to the burner panel. The burner panel defines at least one aperture to provide a gas/air mixture to the top surface of the burner panel, and the burner panel comprises a compression molded material. The burner panel comprises a bottom panel of a combustion chamber enclosure.

In another respect, the invention relates to a gas burner for a fireplace including a burner panel defining a top surface and a bottom surface, wherein the top surface has a raised upper portion and a lower portion, and a bottom burner member coupled to the burner panel. The burner panel defines at least one aperture to provide a gas/air mixture to the top surface of the burner panel, and the bottom surface of the burner panel defines at least one cavity. The raised upper portion of the top surface extends above the lower portion.

The invention also relates to a method for forming a gas burner for use in a prefabricated fireplace including forming a compression molded burner panel, coupling a bottom burner member to the burner panel, and forming at least one aperture in the burner panel.

In another respect, the invention relates to a method of assembling a prefabricated fireplace including providing a combustion chamber enclosure having a burner panel as a bottom panel of the combustion chamber enclosure, the burner panel comprising a compression molded material, and providing an outer enclosure surrounding the combustion chamber enclosure.

The above summary of the present invention is not intended to describe each disclosed embodiment or every implementation of the present invention. The Figures and the detailed description that follow more particularly exemplify embodiments of the invention. While certain embodiment of the invention will be illustrated in describing embodiments of the invention, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

Figure 1:
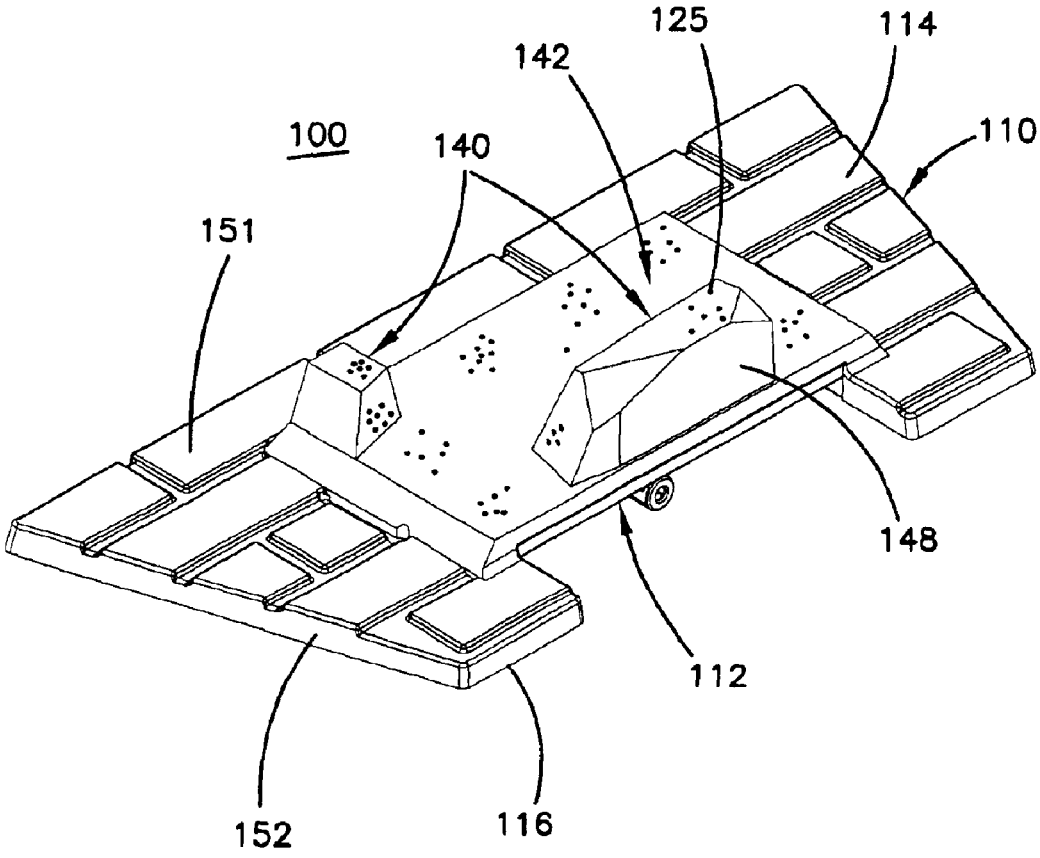
FIG. 1 is a schematic back perspective view of one embodiment of a gas burner, according to the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENTS

The invention is applicable to burners for gas fireplaces, stoves, or inserts. In particular, in some respects, the invention is directed to a monolithic burner panel with elevated areas. In some embodiments, the burner panel is formed by molding techniques, for example through a novel process of compression molding. The monolithic burner panel can be used in a broad variety of applications, for example in a gas burner in a bottom panel of a fireplace combustion chamber enclosure. While the present invention is not so limited, an appreciation of various aspects of the invention will be gained through a discussion of the examples provided below.

Gas Burner Construction

The general structure of the gas burner includes a burner panel coupled to a bottom burner member, which creates a reservoir for a gas/air mixture. The gas/air mixture is then provided to a top surface of the burner panel through at least one burner aperture for combustion. Such a gas burner can have one or more advantages over current burner systems. For example, the monolithic burner panel construction can offer a simple, realistic, easy to install, and cost effective burner for fireplaces. Another possible advantage is that in at least some embodiments, the gas burner does not include mechanical hardware which, when viewed by an onlooker, detracts from the aesthetics and natural look of the fireplace. The monolithic burner panel enhances the look of the fireplace by providing a natural or wood burning appearance to a gas fireplace. The gas burner can include masonry design that simulates a real fireplace. Yet another possible advantage of the gas burner is that the compression molding construction and composition of the burner panel provides a resilient and supportive structure for a fireplace unit. Also, another possible advantage of the gas burner is that in at least some embodiments, the construction includes fewer components than those used in current burner system.

Figure 2:
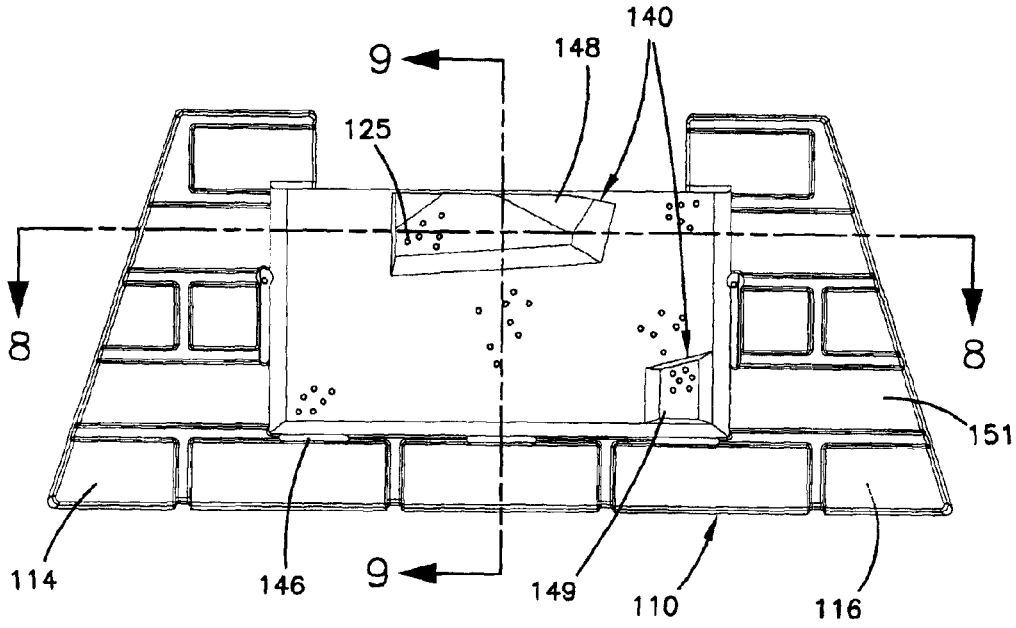
FIG. 2 is a schematic top view the gas burner of FIG. 1, according to the invention.
Figure 3:
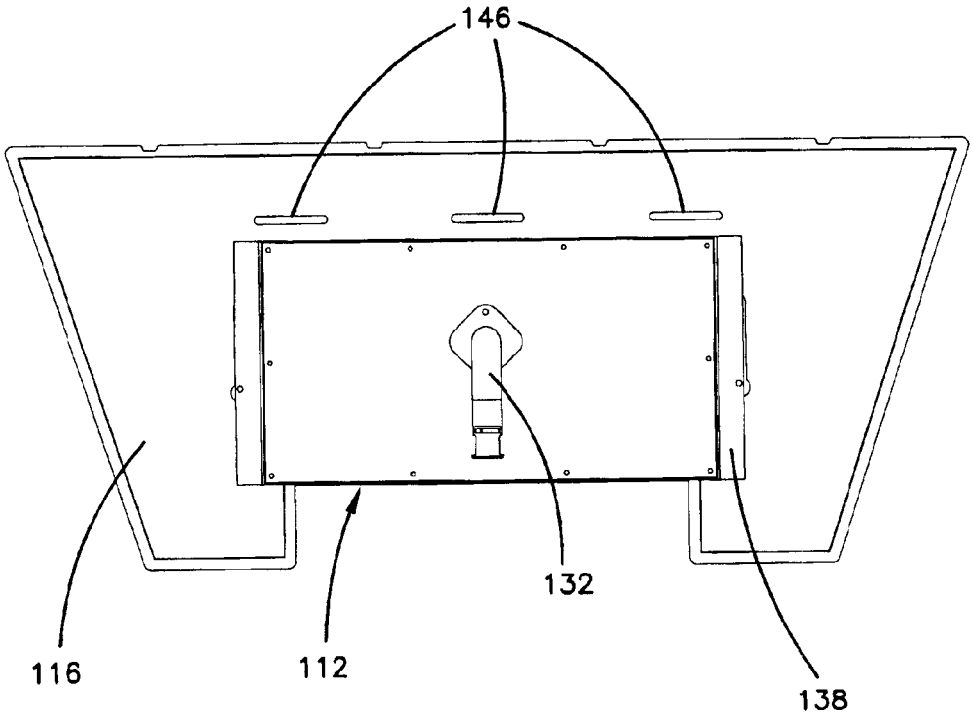
FIG. 3 is a schematic bottom view of the gas burner of FIG. 1, according to the invention.

Referring to FIGS. 1–3, a gas burner 100 is shown including a monolithic burner panel 110 and a bottom burner member 112. The burner panel 110 defines a top surface 114 and a bottom surface 116.

Figure 9:
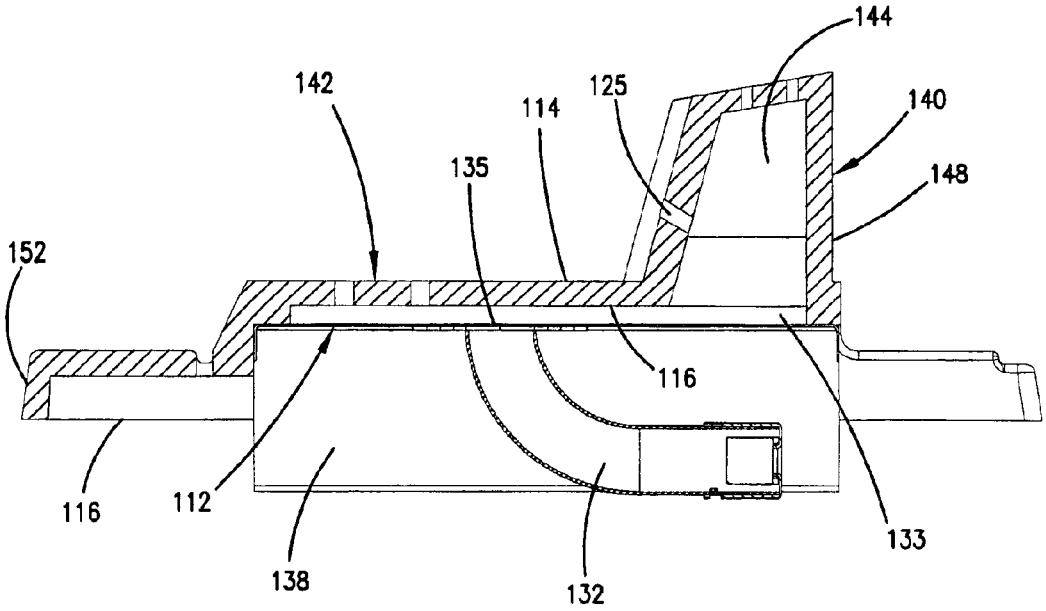
FIG. 9 is a schematic cross-sectional view along line 9—9 of FIG. 2, according to the invention.

The burner panel 110 defines at least one aperture 125 that extends between the bottom surface 116 and the top surface 114 of the burner panel 110, as shown in FIGS. 1 and 9. Preferably, the burner panel 110 includes a plurality of apertures as shown in FIGS. 1 and 2. The gas/air mixture is provided through the plurality of apertures to the top surface 114 for combustion. The apertures can be formed through the burner panel 110, by drilling, punching, or by other methods known to those skilled in the art. Alternatively, the aperture or apertures can be formed during a molding process in which the burner panel is formed. The plurality of apertures can be arranged and configured in any pattern to provide a desired flame pattern on the top surface of the burner panel 110. The diameter of the gas/air apertures can be adjusted to vary the size of flames produced from the combustion of the gas/air mixture on the top surface 114 of the burner panel 110. Air ports 146 defined by the burner panel 110 can provide additional air to the top surface 114 of the burner panel 110 for combustion. (FIG. 2).

The bottom burner member 112 is coupled to the burner panel with suitable mechanical or adhesive coupling techniques. For example, the bottom burner member 112 can be screwed, bolted, bracketed, or adhered with adhesive to the burner panel 110. Optionally, the bottom burner member 112 can be sized to form-fit into an indentation in the burner panel 110. The bottom burner member 112 can be metal, a ceramic fiber material, or other suitable material.

In alternative embodiments, the bottom burner member can be integrated into the construction of the burner panel. The bottom burner member can be composed of a material that is the same as or different from the burner panel. For example, the bottom burner member can be metal and the burner panel composed of a compression molded material. By way of further example, an integrated bottom burner member and burner panel structure can be comprised entirely of the compression molded material.

In one embodiment, the bottom burner member 112 is a plate coupled to the bottom surface 116 of the burner panel 110, as shown in FIG. 3. The bottom burner member 112 can be recessed with the bottom surface 116. (FIG. 3).

Figure 12:
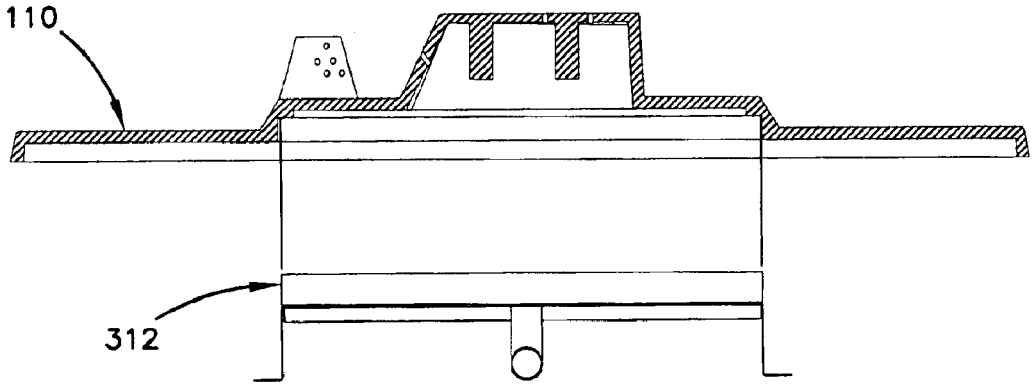
FIG. 12 is a exploded schematic cross-sectional view of an alternative embodiment of a gas burner similar to the embodiment shown in FIGS. 1–9 and 11, but showing the lower burner member as a burner pan, according to the invention.

An alternative embodiment is shown in FIG. 12, wherein the bottom burner member 312 forms a pan coupled to a burner panel 110, and the remaining structure remains identical to the embodiment shown in FIG. 3, and like reference numerals are used to label the same structure. The pan 312 can be formed into any shape, including, but not limited to, a U-shape or a box-shape. It is also contemplated that in yet other alternative embodiments, the bottom burner member can be a shaped plate that corresponds to the shape of the bottom surface of the burner panel or to any other desired shape.

Figure 8:
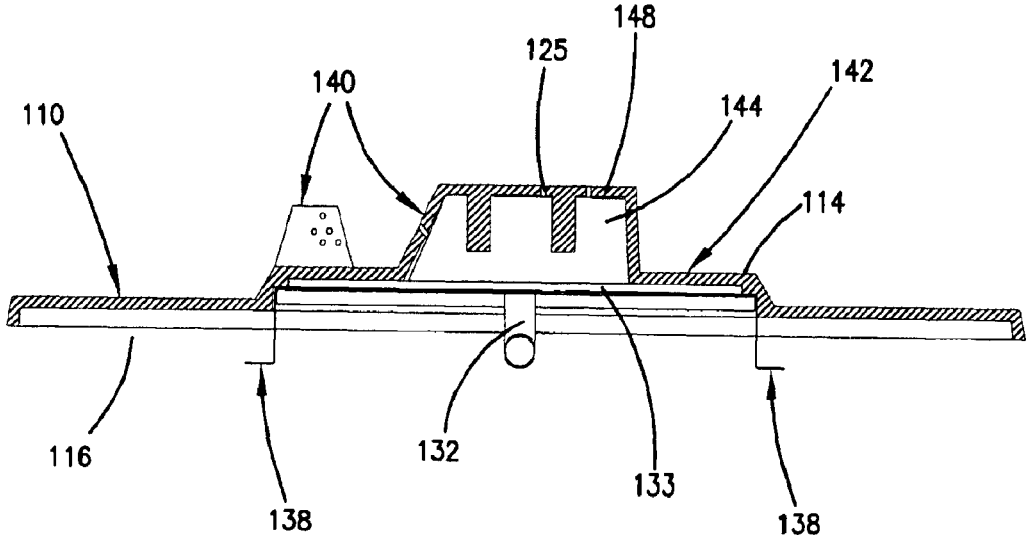
FIG. 8 is a schematic cross-sectional view along line 8—8 of FIG. 2, according to the invention.

As shown in FIGS. 3 and 8, a gas pipe 132 is coupled to the bottom burner member 112 to provide a gas/air mixture to the gas burner 100. An air shutter (not shown) can be coupled to the gas pipe to draw air into the gas pipe to produce a desired gas/air mixture for combustion.

Referring to FIG. 9, the bottom burner member 112 and at least a portion of the bottom surface 116 of the burner panel 110 define a reservoir 133. The gas/air mixture is provided to the reservoir 133 through the gas pipe 132 and a gas pipe aperture 135 defined by the bottom burner member 112. Alternatively, the gas pipe can supply only gas to the reservoir, and air is supplied through other means, for example, through air ports 146. The gas/air mixture flows from the reservoir 133 through the aperture 125 or plurality of apertures to the top surface 114 of the burner panel 110.

As shown in FIG. 1, the top surface 114 of the burner panel 110 includes a raised upper portion 140 and a lower portion 142. The raised upper portion 140 includes areas 148 and 149 that extend above the lower portion 142 of the top surface 114. Specifically, the raised upper portion 140 of the top surface 114 is defined by two elevated areas 148 and 149 that extend above the lower portion 142 of the top surface 114. It should be understood, however, that in alternative embodiments, the raised upper portion of the top surface can include only one elevated area or more than two elevated areas.

The elevated areas 148 and 149 can be formed into any number of generic shapes including, but not limited to, rounded, trapezoid, crescent, or any other desired shape. For example, FIGS. 1 and 2 show elevated areas of a general trapezoid shape having areas of irregular shape.

Optionally, the elevated areas can be formed within the raised upper portion 140 of the burner panel 110 to simulate a fireplace log set. Separate elevated areas can be coupled through a connecting log or logs. If more than one elevated area is included in the burner panel 110, the raised upper portion 140 and lower portion 142 of the burner panel 110 creates a multielevational burner profile.

Figure 5:
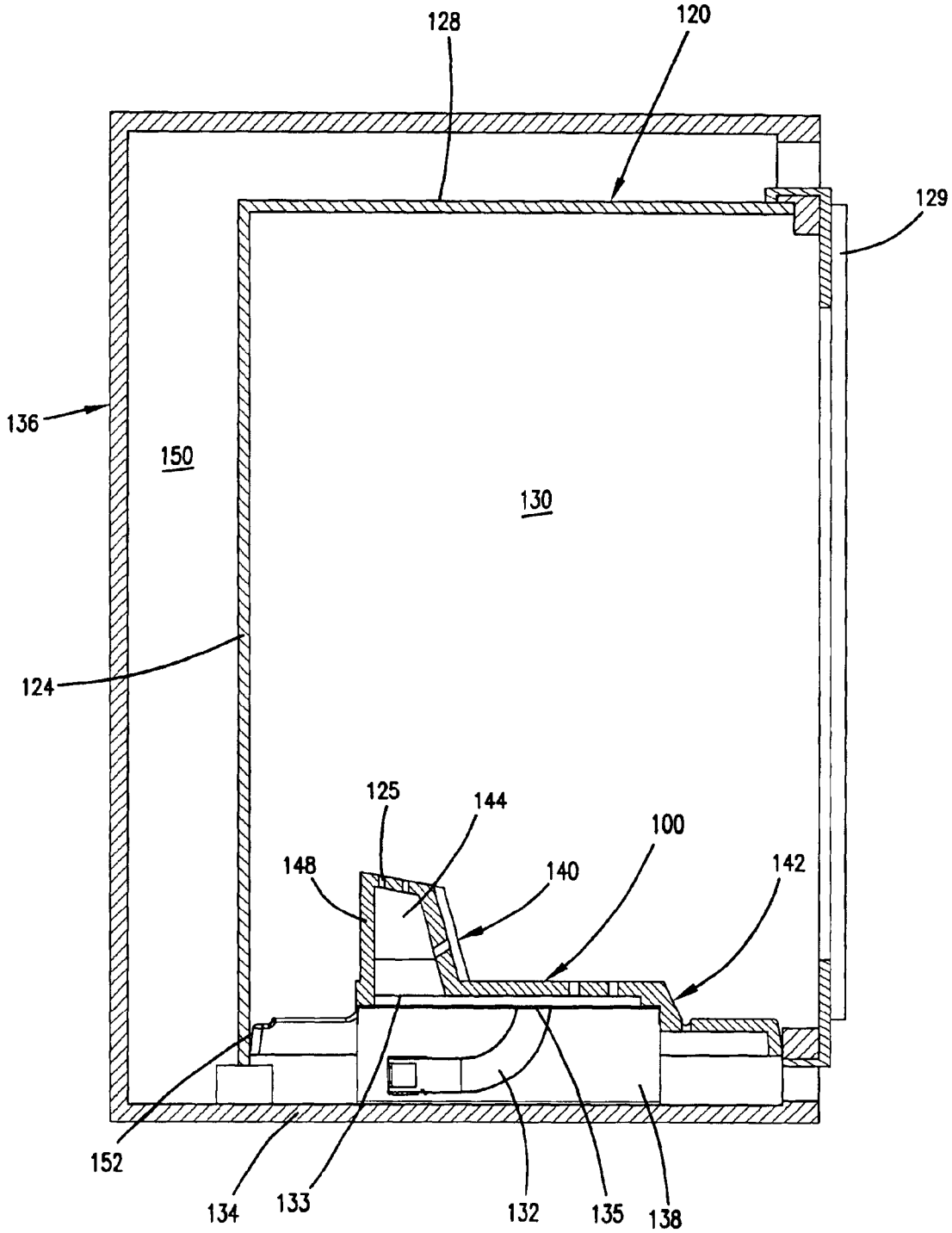
FIG. 5 is a schematic side elevation cross-sectional view of the fireplace unit of FIG. 4 incorporating the gas burner of FIG. 1, according to the invention.

As shown in FIGS. 5, 8, and 9, the bottom surface 116 of the burner panel 110 defines at least one cavity 144 below at least one of the elevated areas 148 or 149. At least a portion of the cavity 144 extends above at least a portion of the top surface 114 of the burner panel 110, for example above the lower portion 142 of the top surface 114 of the burner panel 110, as shown in FIGS. 8–9. It should be understood that in embodiments with multiple elevated areas, there can be at least one cavity below each elevated area, or there can be raised areas that do not include cavities there below.

The one or more cavities 144 are in fluid communication with the reservoir 133, and gas/air mixture can flow from the reservoir 133 into the one or more cavities 144. One or more apertures 125 can be formed in the elevated areas, wherein the apertures 125 extend between the bottom surface 116 and the top surface 114 of the burner panel 110, and are in fluid communication with the cavities 144. The gas/air mixture is provided through the plurality of apertures to top surface 114 for combustion. Therefore, the apertures 125 can be distributed to provide the gas/air mixture on the top surface 114 of the raised upper portion 140, lower portion 142, or both portions. The apertures can be distributed to concentrate flames in particular areas to provide a more natural looking burn.

The burner panel 110 can also include a masonry design 151, for example a design formed into a portion of the top surface 114 of the burner panel 110, as shown in FIGS. 1–3. For example, the masonry design 151 is formed into the lower portion 142 of the burner panel 110 or can optionally cover only a section of the lower portion 142. FIG. 1 shows a simulated brick design on part of the lower portion 142 of the burner panel 110. Other masonry designs include, but are not limited to, stone or concrete. The area of the masonry design 151 can be adjusted to provide a desired portion of the top surface for combustion of the gas/air mixture. Optionally, the masonry design can be formed into the back panel, top panel, and at least one side panel of the combustion chamber enclosure. Alternatively, the burner panel can be formed without a masonry design, or with another design.

In some embodiments, a log or logs not integrated or formed into the burner panel 110 can be arranged on the elevated area 148 or areas of the burner panel to provide a simulated log set. Combinations of preformed logs and non-integrated logs can be used to simulate the natural look of a wood burning fire. Materials can also be integrated into or placed onto the top surface 114 of the burner panel 110 to simulate, for example, glowing embers or ashes. The materials can be coordinated with the plurality of apertures and elevations of the burner panel to provide a natural looking fireplace. For example, a combination of elevated areas on the burner panel, distribution of gas/air apertures, non-integrated logs, embers, and ashes can produce a fire that simulates logs partially through the wood burn process.

A fireplace grate can also be placed on the bottom burner member to enhance the natural look of the fireplace unit. Alternatively, the gas burner can be placed onto or incorporated into the fireplace grate and supported above the combustion chamber enclosure as a separate unit.

Figure 10:
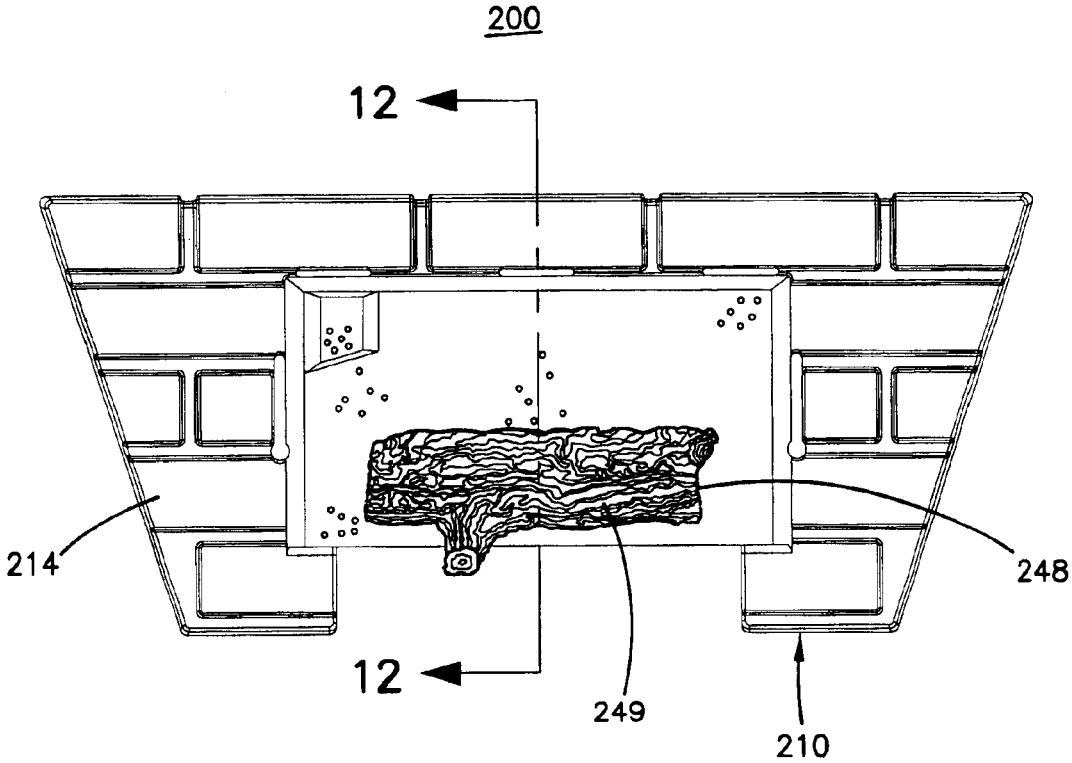
FIG. 10 is a schematic top view of a second embodiment of a gas burner, according to the invention.
Figure 11:
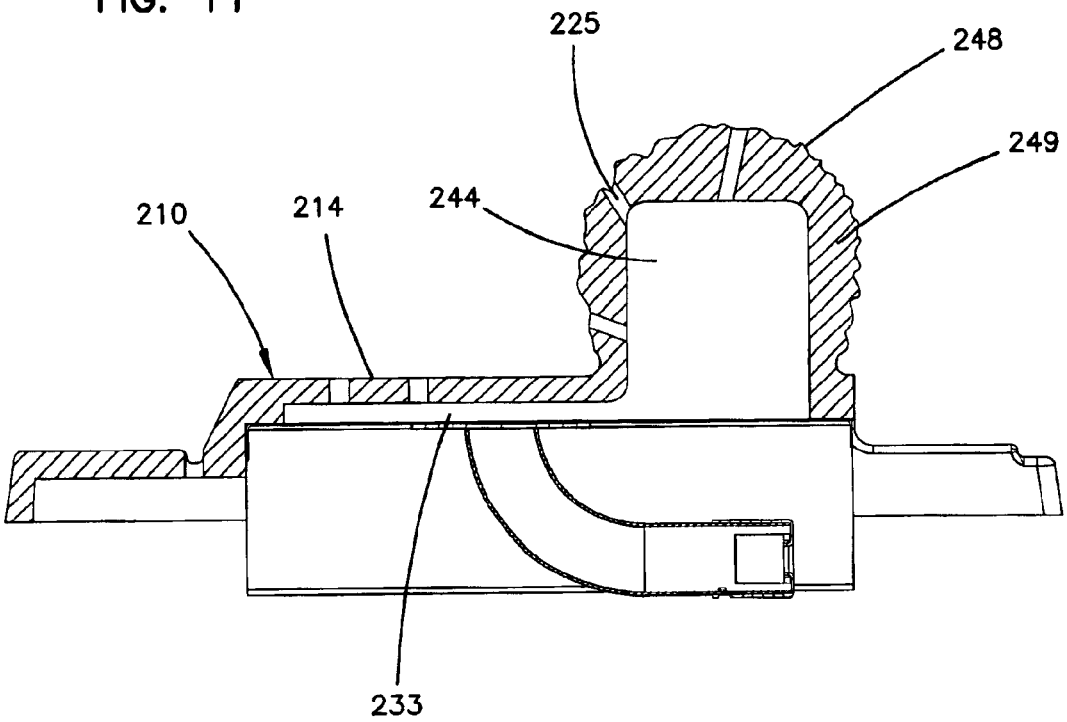
FIG. 11 is a schematic cross-sectional view along line 12—12 of FIG. 2, according to the invention, according to the invention.

In another embodiment as shown in FIG. 10, an elevated area 248 is formed into at least one preformed log 249 that includes contours and detail in a top surface 214 of a burner panel 210 that simulates a log. The burner panel 210 can define at least one aperture 225 through the preformed log 249 to provide the gas/air mixture to the top surface 214 of the burner panel 210, as shown in FIG. 12. Below the elevated area 248, a cavity 244 is formed, which can be coupled to cavities below other elevated areas through a gas/air mixture reservoir 233 that can serve a plurality of apertures in the burner panel 210.

Figure 4:
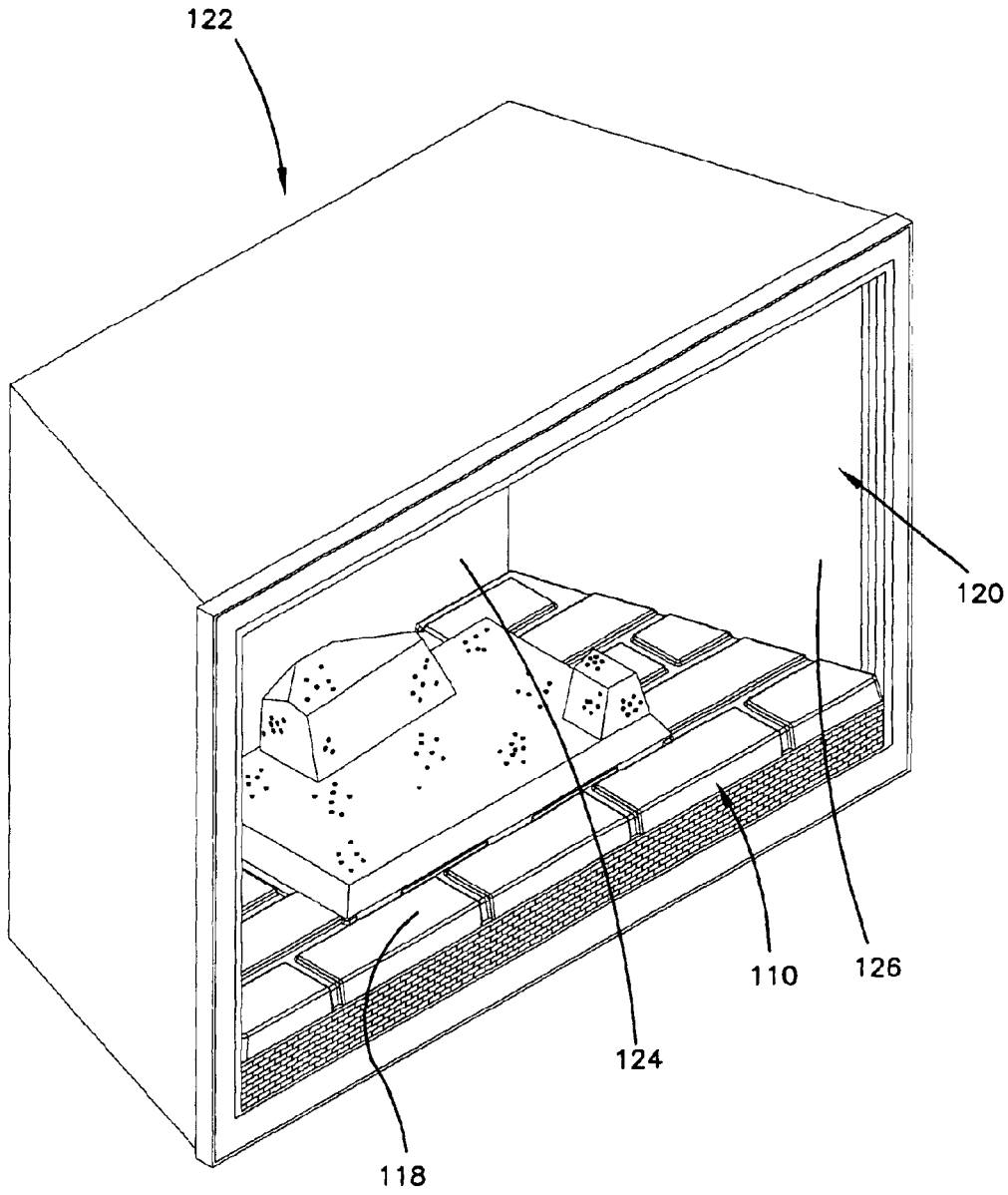
FIG. 4 is a schematic front perspective view of one embodiment of a fireplace unit incorporating the gas burner of FIG. 1, according to the invention.
Figure 6:
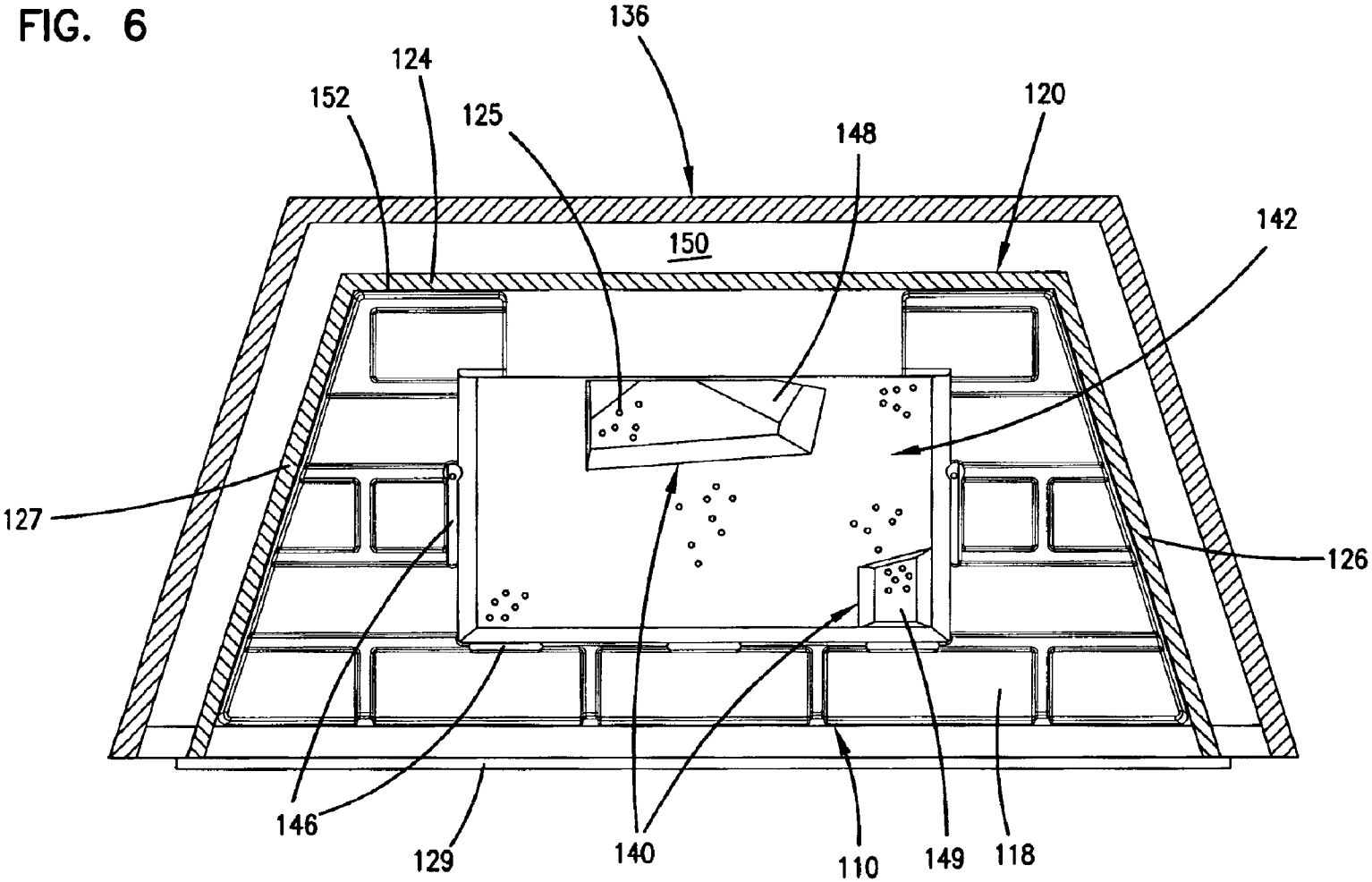
FIG. 6 is a schematic top cross-sectional view of the fireplace unit of FIG. 4 incorporating the gas burner of FIG. 1, according to the invention.
Figure 7:
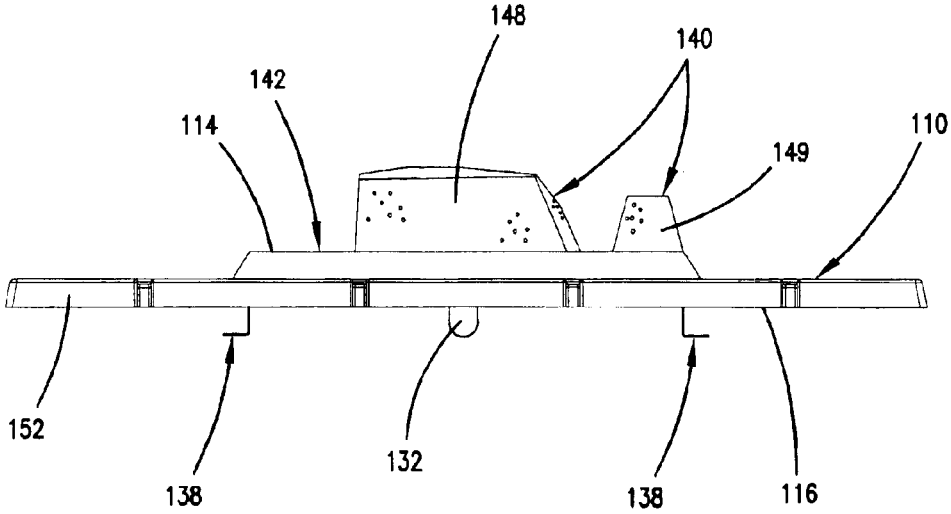
FIG. 7 is a schematic front elevation view of the gas burner of FIG. 1, according to the invention.

Referring to FIGS. 4–6, the burner panel 110 can be used as the bottom panel 118 of a combustion chamber enclosure 120 of a fireplace unit 122. The combustion chamber enclosure 120 includes the bottom panel 118, a back panel 124, at least one side panel 126, and a top panel 128. One or more glass panels can be incorporated into the fireplace unit 122. For example, as shown in FIG. 5, a glass panel 129 coupled with the combustion chamber enclosure 120 forms a combustion chamber 130 for the combustion of the gas/air mixture. The burner panel 110 can be used in any gas fireplace unit, stove, or insert to form the bottom panel of the combustion chamber enclosure for that unit, stove, or insert.

The gas burner 100 can be supported within the fireplace unit 122 above a bottom panel 134 of an outer enclosure 136. For example, in one embodiment, the bottom burner member 112 includes support flanges 138 that support the gas burner 100 in the fireplace unit 122, as shown in FIG. 5. Optionally, a fireplace can include a supporting member that supports the burner panel 110. The burner panel 110 can alternatively be supported within a fireplace by forming the burner panel as an integral part of a combustion chamber enclosure as a monolithic combustion chamber box.

Referring to FIGS. 5 and 6, the burner panel 110 is shown coupled to the back panel 124 and two side panels 126 and 127 of a combustion chamber enclosure 120. An outer enclosure 136 surrounds the combustion chamber enclosure 120. The outer enclosure 136 and combustion chamber enclosure 120 can define a passageway 150 within the fireplace unit 122. The burner panel 110 can be form-fit, mechanically, or adhesively coupled to the back panel 124 and at least one side panel 126. The burner panel 110 can be mechanically attached with, for example, screws, bolts, brackets, or any other suitable attachment device, known to those skilled in the art.

A side surface 152 defined by the burner panel 110 can be coupled to the back panel 124 and at least one side panel 126 of the combustion chamber enclosure 120. The burner panel 110 is coupled through form-fit engagement of the side surface 152 onto the surfaces of the back panel 124 and the side panel 126. The size of the support flanges 138 can be adjusted to provide proper positioning and fitting of the gas burner 100 within the fireplace unit 122.

Optionally, the back panel and side panels can include groves for engagement of the burner panel. The burner panel can alternatively be integrated into the back panel, at least one side panel, and top panel as a monolithic molded combustion chamber box.

In one embodiment, the fireplace unit 122 includes a strip of material in engagement with the back panel 124 and side panels 126 of the combustion chamber enclosure 120 that couples the burner panel 110 to and forms a portion of the bottom panel 118.

In some embodiments, the burner panel 110 is formed as a compression molded material. One embodiment of a compression molded material includes an inorganic fiber and a binder. The compression molded material can be formed into one monolithic burner panel for use as the bottom panel 118 of a combustion chamber enclosure 120. The compression molded burner panel 110 can also be integrated into the combustion chamber enclosure as monolithic molded combustion chamber box through compression molding the entire enclosure with one mold.

The gas burner 100 and the burner panel 110 can be used in any prefabricated gas fireplace such as, for example, a direct vent, a universal vent, a B-vent, a horizontal/vertical-vent, a dual direct vent, a multisided unit having two or three glass panels as combustion chamber side panels, or in any fireplace unit, stove, or insert that requires a gas burner. Some specific examples of other structures that can be used in accordance with the gas burner 100 and burner panel 110 include those disclosed in U.S. Pat. Nos. 5,941,237 and 5,996,575 which are hereby incorporated herein by reference.

Method for Forming a Burner Panel

It should be understood by those of skill in the art, and others, that the burner panel 110 can be formed through any techniques generally known in the art, for example through vacuum molding, or other molding, casting or forming techniques. One preferred method of forming the burner panel is through a novel compression molding technique. Compression molding includes steps to produce a monolithic burner panel that is compression molded, and made of a compression molded material.

The first step involved in such a molding method entails providing a molding composition including inorganic fiber. The molding composition generally includes inorganic fibers, binder, carrier solvent, and optional additives. A more detailed discussion of some embodiments of the molding composition will be provided below.

The next step entails compression molding the molding composition. Compression molding as used herein generally involves the use of a heated mold and compressive pressure produced by the mold to form the moldable composition into a desired shape. Many compression molding techniques may be used. For example, in some embodiments the mold comprises a plurality of matched dies, and in some embodiments, a pair of dies, for example male and female dies, that mate with each other to form a mold cavity or mold cavities. In some embodiments, the dies are attached to equipment that is designed to bring the dies together with enough compressive pressure to perform the molding. The dies can be constructed so apertures can be formed into the article. It is contemplated that in other embodiments, the weight of the dies can create enough compressive pressure to perform the molding. The dies are typically preheated to a molding temperature, and a measured quantity of moldable composition including inorganic fiber is placed in the heated mold. In some embodiments, the moldable composition is placed in the heated mold when the mold is in the open position, and the mold is closed and the moldable composition, through pressure applied from the closing of the mold, fills the mold cavity. Continued heating at least partially cures the moldable composition within a relatively short period of time, in some embodiments within a matter of minutes, such that the molded article retains its shape. Pressure is then released, the dies are separated, and the molded article is removed from the mold.

It should also be understood that in some embodiments of compression molding, the moldable composition is forced into the heated mold through one or more injection ports using appropriate injection techniques when the mold is in the closed position. The moldable composition, through pressure from the injection process, and compression from the closed mold dies, fills the mold cavity, and is formed into the desired shape. Therefore, it will be understood that as used herein, the terms "compression molding" are intended to include embodiments using such injection techniques, and any other compression molding techniques.

After the molding process is complete, and the molded article is removed from the mold, it can be further dried by either air drying, or in some cases, by oven drying or firing. In some embodiments, however, the article can be dried by being held in the heated mold for a longer period of time to achieve the desired drying.

For larger articles, for example, a molded combustion chamber or burner panel, drying can be achieved by oven drying after removal from the mold at a temperature in the range of 350° F. and 1800° F., more preferably in the range of 650° F. to 750° F. for a sufficient amount of time to drive off any of the remaining excess water from the mold solution. The dry time depends greatly upon the method of drying used, and the article being formed.

After the drying, the article can be trimmed or machined to a final desirable shape, if needed, and colored as desired. Apertures can also be formed into the burner panel after the molding process.

Molding Composition Formulation

The molding composition to form a compression molded burner panel generally includes inorganic fibers, binder, carrier solvent, and optional additional additives.

The inorganic fiber is generally described as fibers made of one or more inorganic materials. Some examples of inorganic fibers include ceramic fibers, refractory fibers, refractory ceramic fibers (RCF), mineral fibers, or other like inorganic fibers, or mixtures thereof. Such fibers can include, for example, staple fiber, spun fiber, continuous fiber, bulk fiber, filament fiber or wool fibers or the like, or mixtures thereof. Additionally, the fibers can be in a broad variety of forms, for example, in a crystalline or polycrystalline form, or the like, or mixtures thereof. Refractory ceramic fibers (RCFs), along with fibrous glass and mineral wool, are often times grouped as man-made materials generally referred to as synthetic vitreous fibers (SVF). All these products are made from molten masses of raw materials, under controlled conditions.

In some embodiments the fibers are selected from chopped fiber glass, alumina silicate RCF, or mixtures thereof. In some embodiments, especially those for use in high temperature environments, it is preferable to use fibers that can withstand high temperatures. For example, in such embodiments, it is preferable to use fibers that can withstand temperatures of at least 800° F., more preferably at least 1000° F., more preferably at least 1200° F., and more preferably 1300° F., without significant degradation or deterioration due to the heat.

In some embodiments, the fibers range in length from less than 1/16 of an inch to two inches, preferably from 1/16 of an inch to 1 inch, and more preferably from 1/8 of an inch to 1/2 of an inch. In some embodiments, the fibers have a diameter in the range of 1 micron to 30 microns, preferably in the range of 4 microns to 9 microns, and more preferably in the range of 5 microns to 7 microns.

The fibers can make up a major component of the composition, for example in some envisioned embodiments, up to 80% or more of the composition. However, in some embodiments, a significant amount of fillers, for example inorganic fillers, can be used, thereby reducing the necessary concentration of inorganic fiber.

The binder used acts to bind the components of moldable composition together when cured during the molding process. The binders include inorganic or organic binders generally known, and mixtures thereof. Examples of binders include silica, sodium, calcium, and magnesium based binders, and the like, or mixtures thereof. Other examples include polymeric materials, petroleum distillate, polyethylene oxide, and the like, or mixtures thereof. In some embodiments, the binder can be hydrous, anhydrous, crystalline, or amorphous. In some embodiments, the binder within the molding composition in the form of a dispersion, emulsion, slurry or solution with the carrier medium.

In some embodiments, especially those for use in high temperature environments, it is preferable to use binders that can withstand high temperatures. For example, in such embodiments, it is preferable to use binders that can withstand temperatures of at least 800° F., more preferably at least 1000° F., more preferably at least 1200° F., and more preferably 1300° F., without significant degradation or deterioration due to the heat. The preferred binders include amorphous silica.

The carrier solvent typically acts to create a dispersion, emulsion, slurry or solution with the rest of the components. Preferably, the moldable composition is in the form of a slurry. In most embodiments, the carrier solvent is burned off or leaves due to the heat during the molding process, and little or none remains in the finished molded article. The preferred carrier solvent for most embodiments is water. In at least some embodiments, the moldable slurry preferably includes water as the primary carrier solvent, and the slurry preferably has a moisture content in the range of 20 to 35%, more preferably 23 to 30%, and most preferably 25 to 27% by weight of the total slurry composition.

Additional additives can optionally be included within the molding composition to provide the molding composition or the final molded article with desirable properties. For example, additives can be included to enhance the emulsion or dispersion of the components of the composition, to enhance the moldability of the composition. Some examples of additives include inorganic or organic fillers, surfactants, diluents, thickeners, solvents, dyes or colorants, or other appearance enhancing materials, and the like, or mixtures thereof.

Fillers can be used, for example, to increase the volume of the composition and reduce the necessary amount of inorganic fiber. Additionally, some fillers can be added to impart desired properties to the final molded article. Examples of fillers include inorganic or organic fillers that are compatible with the other components in the composition. Preferred fillers include inorganic fillers, for example silica compounds, such as alumina silicate, crystalline silica, and the like. Another example of an inorganic filler includes ceramic microspheres, and the like.

In some embodiments, an example of a preferred emulsion or dispersion agent is petroleum distillate, hydrotrated light. This material can also act as a carrier in the formulation. Nonylphenol polyethylene oxide is another example of a dispersing or emulsifying agent that can also act as a surfactant.

In some embodiments, an organic polymer, such as an acrylic polymer, is added to the composition to act as a dispersing agent, and also to act as a thickener to help the composition hold shape when it is being molded. Typically, this type of material is burned off during the molding process. It is contemplated that these, and many other additives can be used in compositions embodying the invention.

Representative constituent concentrations for base components of some compositions embodying the invention can be found in Table 1, wherein the values are given in wt. % of the ingredients in reference to the total composition weight.

TABLE 1

| Component | Exemplary wt. % Range | Preferred wt. % Range | More Preferred wt. % Range |
|---|---|---|---|
| Inorganic Fiber | up to 80%, but preferably 75% or less | 25% or less | 10% or less |

TABLE 1-continued

| Component | Exemplary wt. % Range | Preferred wt. % Range | More Preferred wt. % Range |
|---|---|---|---|
| Binder | 10 to 40% | 15 to 35% | 20 to 30% |
| Carrier Solvent | 15 to 45% | 20 to 40% | 25 to 35% |
| Additives | 0 to 70% | 25 to 80% | 33 to 54% |

Some preferred embodiments comprise the constituent concentrations for base components as found in Table 2, wherein the values are given in wt. % of the ingredients in reference to the total composition weight.

TABLE 2

| Component | Example wt. % Range | Preferred wt. % Range | More Preferred wt. % Range |
|---|---|---|---|
| Inorganic Fiber | 25% or less | 10% or less | 5% or less |
| Binder | 10 to 40% | 15 to 35% | 20 to 30% |
| Water | 15 to 45% | 20 to 40% | 25 to 35% |
| Inorganic Filler | 15 to 70% | 20 to 60% | 30 to 54% |
| Other additives | 0 to 10% | 0 to 5% | 0.1 to 2% |

In some embodiments, the molding composition is made by mixing the inorganic fibers and any filler with a binder solution which is in aqueous form and includes any additional additives. After the combination of fibers, filler and binder solution are mixed together, they are agitated so that the fibers completely adsorb the binder solution. After the mixing and agitation occurs, a slurry or paste is formed that is of a consistency which permits the mixture to be used to fill the compression mold, and is ready to be molded.

One specific example of a molding composition comprises the constituent concentrations for base components as found in Table 3, wherein the values are given in wt. % of the ingredients in reference to the total composition weight.

TABLE 3

| Component | Weight Percent |
|---|---|
| Chopped Fiber Glass | 3.3% |
| Colloidal Silica (in a 50% water solution) | 60% |
| Alumina Silicate | 34% |
| Acrylic Polymer | 0.2% |
| Ceramic Microspheres | 2.5% |

Another specific example of a molding composition comprises the constituent concentrations for base components as found in Table 4, wherein the values are given in wt. % of the ingredients in reference to the total composition weight.

TABLE 4

| Component | Weight Percent |
|---|---|
| Chopped Fiber Glass | 3.3% |
| Colloidal Silica (in a 50% water solution) | 60% |
| Alumina Silicate | 34% |
| Acrylic Polymer | 0.2% |
| Ceramic Microspheres | 2.5% |

One preferred moldable slurry of ceramic fibers is a product named THERMOSEAL® Moldable P244 which is commercially available from Mid-Mountain Materials Incorporated of Seattle, Wash. Another preferred moldable slurry of ceramic fibers is a product named THERMOSEAL® Moldable P254 which is commercially available from Mid-Mountain Materials Incorporated of Seattle, Wash.

In some embodiments, the molding composition or the finished article, are made up of primarily inorganic materials. For example, in some embodiments, the molding composition or the finished article, include at least 75% by weight inorganic material, or in other embodiments, at least 90% by weight inorganic material, and in still other embodiments, at least 95% by weight inorganic material, and sometimes at least 99% by weight inorganic material. It is also contemplated that in some embodiments, the molding composition, prior to molding, includes a mixture of inorganic and organic material, but that a significant portion of the organic material will be burned off, or leave during the molding process, leaving the final compression molded article to be made up of primarily inorganic materials. In some embodiments, especially those for use in high temperature environments, it is preferable that the final compression molded article comprises materials that can withstand high temperatures. For example, in such embodiments, it is preferable to use fibers, binders, or any other optional ingredients, such as fillers, that when molded into the final article can withstand temperatures of at least 600° F., or at least 800° F., or least 1000° F., or at least 1200° F., and more preferably at least 1300° F., without significant degradation or deterioration due to the heat.

Although some methods of forming a monolithic burner panel using compression molding techniques are described in detail above, it will be understood by those of skill in the art and others that many other molding, canting and forming techniques can be used.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A gas burner for a fireplace, comprising:

a burner panel defining top surface and a bottom surface; wherein the burner panel is molded to form at least one preformed log;

a bottom burner member coupled to the burner panel;

wherein the burner panel defines at least one aperture to provide a gas/air mixture to the top surface of the burner panel;

wherein the bottom surface of the burner panel and bottom member define at least one cavity;

wherein the at least one preformed log defines at least a portion of the at least one cavity; and wherein the at least one cavity extends above at least a portion of the top surface of the burner panel.

2. The gas burner of claim 1, wherein the burner panel comprises a compression molded material, the compression molded material comprising an inorganic fiber and a binder.

3. The gas burner of claim 1, wherein the bottom surface of the burner panel defines two or more cavities.

4. The gas burner of claim 1, wherein the burner panel defines a plurality of apertures to provide a gas/air mixture to the top surface of the burner panel.

5. A gas burner for a fireplace, comprising:

a burner panel defining a top surface and a bottom surface, wherein the top surface has a raised upper portion and a lower portion;

a bottom burner member coupled to the burner panel;

wherein the burner panel defines at least one aperture to provide a gas/air mixture to the top surface of the burner panel;

wherein the bottom surface of the burner panel and the bottom burner panel together define at least one cavity;

wherein the at least one cavity extends above the lower portion of the top surface of the burner panel; and wherein the raised upper portion of the top surface extends above the lower portion.

6. The gas burner of claim 5, wherein the burner panel defines a plurality of apertures to provide a gas/air mixture to the top surface of the burner panel.

7. A method for forming a gas burner for use in a prefabricated fireplace, comprising:

forming a compression molded burner panel;

coupling a bottom burner member to the burner panel;

forming at least one aperture in the burner panel; and forming at least one cavity in a bottom surface of the burner panel, wherein the at least one cavity extends above at least a portion of a top surface of the burner panel.

8. A method for forming a gas burner for use in a prefabricated fireplace, comprising:

forming a compression molded burner panel;

coupling a bottom burner member to the burner panel;

forming at least one aperture in the burner panel; and forming a prefabricated log in at least a portion of the burner panel.

* * * * *

UNITED STATES PATENT AND TRADEMARK OFFICE

CERTIFICATE OF CORRECTION

PATENT NO. : 6,875,012 B2
DATED : April 5, 2005
INVENTOR(S) : Lyons et al.

It is certified that error appears in the above-identified patent and that said Letters Patent is hereby corrected as shown below:

Column 11,
Line 48, insert -- a -- between “defining” and “top”.

Signed and Sealed this

Eleventh Day of October , 2005

JON W. DUDAS
*Director of the United States Patent and Trademark Office*